US010962031B2

(12) United States Patent
Stoenner et al.

(10) Patent No.: US 10,962,031 B2
(45) Date of Patent: Mar. 30, 2021

(54) CONTROL DEVICE

(71) Applicant: HYDAC SYSTEMS & SERVICES GMBH, Sutzbach/Saar (DE)

(72) Inventors: Christoph Stoenner, St. Ingbert (DE); Sascha Alexander Biwersi, Mettlach (DE); Peter Jakobs, Saarbruecken (DE)

(73) Assignee: HYDAC SYSTEMS & SERVICES GMBH, Sulzbach/Saar (DE)

( * ) Notice: Subject to any disclaimer, the term of this patent is extended or adjusted under 35 U.S.C. 154(b) by 330 days.

(21) Appl. No.: 16/082,005

(22) PCT Filed: Mar. 16, 2017

(86) PCT No.: PCT/EP2017/000345

§ 371 (c)(1),
(2) Date: Sep. 4, 2018

(87) PCT Pub. No.: WO2017/167435

PCT Pub. Date: Oct. 5, 2017

(65) Prior Publication Data

US 2020/0340499 A1 Oct. 29, 2020

(30) Foreign Application Priority Data

Apr. 1, 2016 (DE) ..... 10 2016 003 972.8

(51) Int. Cl.
*F15B 11/16* (2006.01)
*B66C 13/20* (2006.01)

(52) U.S. Cl.
CPC ..... *F15B 11/166* (2013.01); *B66C 13/20* (2013.01); *F15B 2211/329* (2013.01);
(Continued)

(58) Field of Classification Search
CPC ..... F15B 11/165; F15B 20/007; F15B 2211/875; F15B 2211/8755
See application file for complete search history.

(56) References Cited

U.S. PATENT DOCUMENTS 4,129,987 A * 12/1978 Blume ..... F15B 11/15 60/445
5,794,511 A * 8/1998 Sorbel ..... E02F 9/2267 91/536

(Continued)

FOREIGN PATENT DOCUMENTS

DE 30 16 929 5/1989
DE 197 14 141 10/1998

(Continued)

OTHER PUBLICATIONS

International Search Report (ISR) dated May 19, 2017 in International (PCT) Application No. PCT/EP2017/000345.

*Primary Examiner* — Abiy Teka
*Assistant Examiner* — Matthew Wiblin
(74) *Attorney, Agent, or Firm* — Wenderoth, Lind & Ponack, L.L.P.

(57) ABSTRACT

A control device for at least one hydraulic working section (A, B), which can be connected to a pressure supply source (P) and a return flow (T) via a hydraulic supply circuit and to a control valve (34) supplied with a pilot pressure. The device includes an emergency shutdown system (32) having a pilot solenoid valve (16) and an additional valve (14). Both the hydraulic energy flow from the pressure supply source (P) to at least one of the respective working sections (A, B) and the pilot pressure supply to the control valve (34) can be suppressed by the pilot solenoid valve (16) via the additional valve (14).

9 Claims, 2 Drawing Sheets

(52) U.S. Cl.
CPC ..... *F15B 2211/50518* (2013.01); *F15B 2211/6355* (2013.01); *F15B 2211/8755* (2013.01)

(56) References Cited

U.S. PATENT DOCUMENTS

| | | | | |
|---|---|---|---|---|
| 6,250,202 | B1 | 6/2001 | Buttner et al. | |
| 7,222,484 | B1 * | 5/2007 | Dornbach | B66F 9/22 60/422 |
| 2005/0098030 | A1 | 5/2005 | Rollmann | |
| 2005/0204734 | A1 * | 9/2005 | Oka | E02F 9/2296 60/428 |
| 2007/0210645 | A1 * | 9/2007 | Dornbach | F15B 11/165 303/113.2 |
| 2010/0242464 | A1 * | 9/2010 | Vigholm | E02F 9/2296 60/327 |
| 2014/0366521 | A1 * | 12/2014 | Tanaka | E02F 9/225 60/464 |

FOREIGN PATENT DOCUMENTS

| | | |
|---|---|---|
| DE | 103 42 789 | 4/2005 |
| EP | 1 369 598 | 12/2003 |
| EP | 1 686 268 | 12/2011 |

* cited by examiner

CONTROL DEVICE

FIELD OF THE INVENTION

The invention relates to a control device for at least one hydraulic working section, which can be connected to a pressure supply source and a return via a hydraulic supply circuit and a pilot pressure-supplied control valve. The control device has an emergency-stop device comprising a pilot solenoid valve and another valve.

BACKGROUND OF THE INVENTION

EP 1 686 268 B1 discloses a generic hydraulic control device for at least one hydraulic consumer. At least one working line can be connected to a pressure source and a return via a directional control valve. That control device has a load pressure control circuit and an emergency stop system, which has a separating valve between the pressure source and a supply line leading to the directional control valve. The separating valve is at least pressure-controlled for a passage position and spring-loaded for the blocking position. A solenoid switching valve is provided between the pressure source and the separating valve. A spring chamber of the separating valve is connected to the return. The magnetic switching valve is a 2/2-way valve, which is arranged between the pressure source and the spring chamber of the separating valve. The separating valve is a 2/2-way valve, the control side of which, provided for setting the passage position, is permanently connected to the pressure source. At least one aperture device is provided between the spring chamber and the return.

In that known solution, the two 2/2-way valves are a solenoid valve on the one hand and a spring-pressure-controlled valve on the other hand. In normal operation, the separating valve in the known solution is not held in the passage position by the emergency stop solenoid valve, but by the pilot pressure derived from the delivery pressure of the pressure source. For emergency stop, the emergency stop solenoid valve is de-energized and switched to its passage position, resulting in the control pressure then acting in parallel to the spring for setting and holding the shut-off position of the isolation valve. The aperture device between the spring chamber and the return permits a permanent discharge of pressure media, without endangering the shut-off position of the separating valve.

In the known solution, the pilot pressure generation is arranged in an attachment plate in parallel to the emergency stop shutdown system. This arrangement means that sufficient pressure can always be generated in the pilot circuit without any additional secondary measures, both for fixed-displacement pump systems and for variable-displacement pump systems. Regardless of the emergency stop function mentioned, it is then possible to deflect the control slide of the working sections based on an internal pilot pressure generation after an electro-hydraulic actuation. In this way, the emergency stop function can prevent the hydraulic energy flow from the pump having the pressure supply port P to the respective working ports A or B and thus to the connected hydraulic consumer, but not the energy flow from the working port A or B to the tank or to the return T. As in practice, often pushing or pulling loads are present at the working ports of the control blocks of mobile machines, and thus, rest against the control slider.

Unwanted movements at the consumers can then occur in spite of the emergency stop function in the pump inlet, presenting a safety risk.

SUMMARY OF THE INVENTION

Based on this state of the art, the invention addresses the problem of further improving a control device of the type mentioned to the effect that increased safety is achieved during operation.

A control device of this invention basically solves this problem, wherein a pilot solenoid valve can be used to stop both the hydraulic energy flow from the pressure supply source to at least one of the respective working sections and the pilot pressure supply to the control valve via another valve. Even in the case of pushing or pulling loads at the working ports of the control blocks, no unwanted movements can occur at the consumers if the emergency stop function is activated.

By using a diverter valve, preferably in the form of a 3/2-way valve, as a further valve of the emergency-stop device instead of a "unidirectionally" acting 2/2-way valve according to the known solution described above, the logic circuitry can then be extended in such a manner that the system can simultaneously be used as a kind of OR gate or OR element in the overall hydraulic system of mobile machines. A diverter circuit can be used to actuate various working sections.

Different 2/2-way pilot solenoid valves (normally open, normally closed) can be used to define the position in which the emergency stop valve is to be de-energized and energized, with the hydraulic supply circuit being activated in doing so.

The embodiment "A1" of the control device can be used to selectively supply two different hydraulic circuits via the OR gate and to completely decouple them from each other in operation from a safety point of view, thereby enabling a hydraulic working section to be actuated by a hydraulic consumer. For example, the hydraulic consumer may be in the form of a crane or lifting arm having a hydraulically actuatable working cylinder, which can be switched off or disconnected from the pressure supply by an upstream control valve supplied with pilot-pressure, provided that the emergency stop valve (pilot solenoid valve) upon actuation causes a corresponding switch position at the diverter valve (3/2-way valve). This operation then directly establishes the hydraulic supply of another hydraulic working section, being, for example, of hydraulically actuatable support cylinders of a mobile crane or the like, thus ensuring that in operation, even if a load acts on the control device, the mobile crane can in no way overturn.

In the second alternative embodiment, port "T1" instead of port "A1", notably fixed-displacement pump systems can be switched between the internal working circuit of the respective working sections and either the neutral circulation in the direction of the tank or the return T via the port "T1".

Preferably, the typical neutral circulation of fixed-displacement pump systems is routed via a circulation pressure compensator in the mounting plate of the device. As it is always unilaterally spring loaded depending on the valve design and dimensioning, depending on the spring pre-load, usually between 9 and 16 bar, this pre-load in conjunction with the pump volume flow represents a power loss. As the diverter valve or the OR gate does not have any regulation tasks, but shall only be designed as a shift valve, the spring force mentioned can accordingly be rated smaller. This logic can be used to reduce the power loss by a factor of 3 to 4 compared to conventional systems, as described, and can be combined with the safety shutdown.

Preferably, the solution according to the invention further provides, due to an arrangement of the device components in which a protective filter is the first link in a chain upstream of the pilot solenoid valve, protection against contamination of both the pilot solenoid valve and optionally a downstream aperture device, preferably in the form of a flow regulator. This arrangement significantly contributes to the reduction of the potential risk of the safety functions failing.

Further, it is preferably provided that downstream of the emergency stop shut-off valve, a measuring port MS connected in the hydraulic circuit shall provide the option of monitoring the pressure between the emergency stop valve or the pilot solenoid valve, respectively, and the respective working sections. Hence, the switching position of the emergency stop valve. Preferably, a further flow regulator is provided on the pressure supply side to the pilot valves of the control valve, which contributes to small leakages being discharged via the emergency stop valve in the direction of the control oil tank line Z of the pilot pressure control for the control valve, and thus, prevents the pressure signal at the measuring port MS from becoming distorted.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
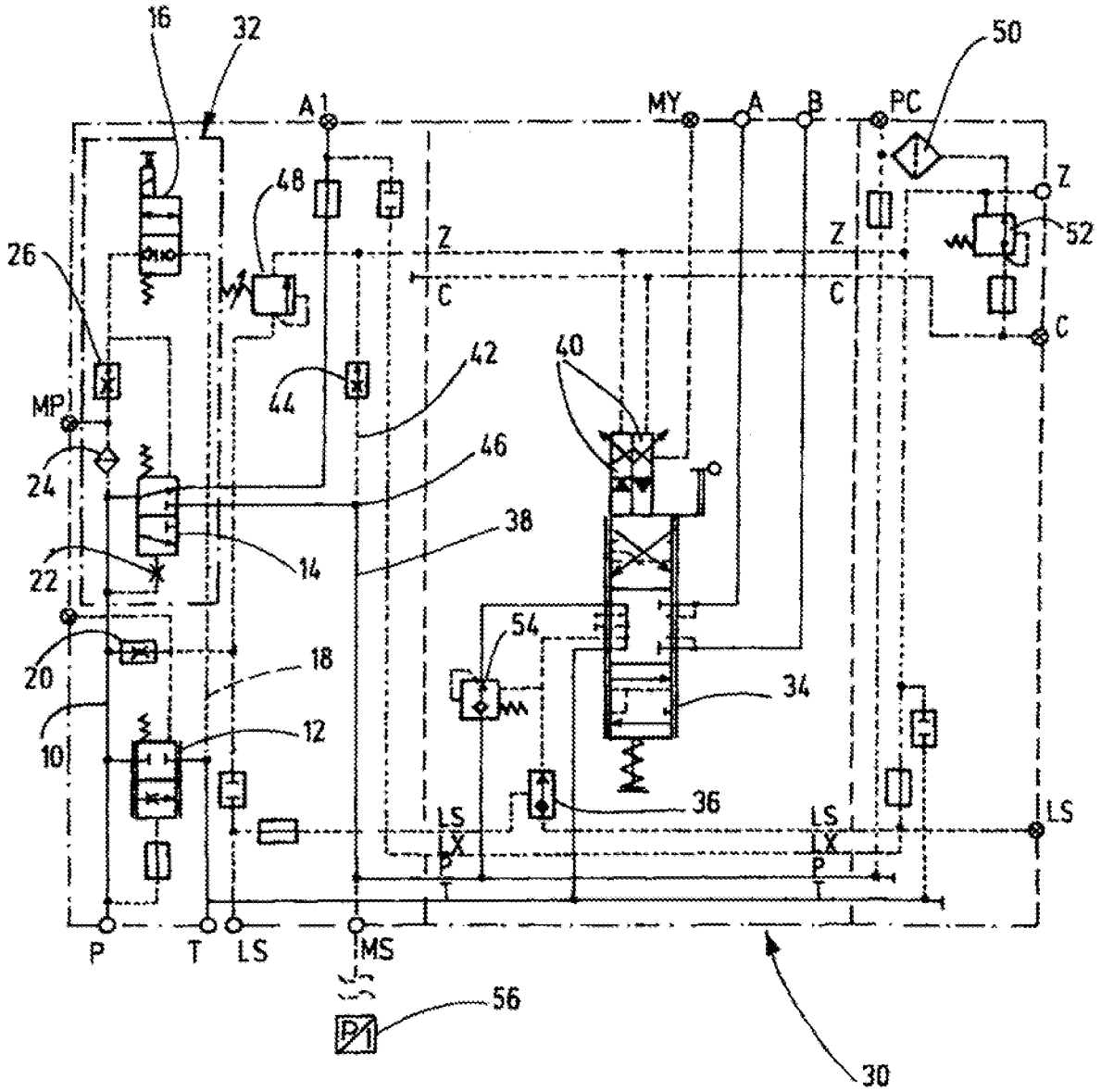
FIG. 1 is a schematic hydraulic circuit diagram of the essential components of a control device according to a first exemplary embodiment of the invention.
Figure 2:
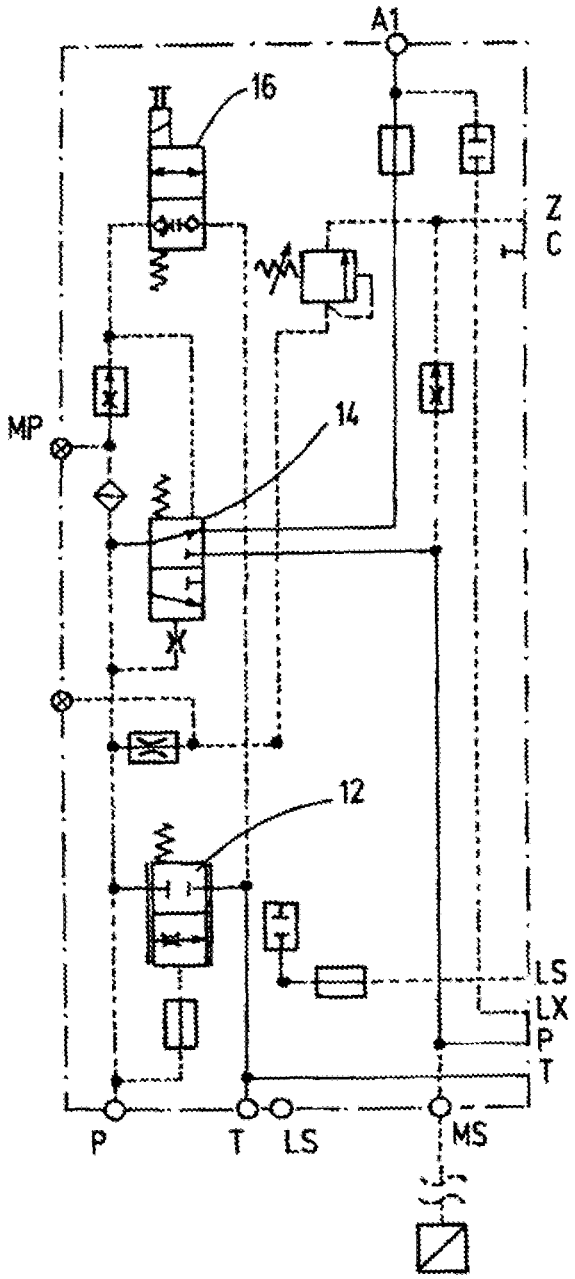
FIGS. 2 and 3 are schematic hydraulic circuit diagrams of control devices according to the second and third exemplary embodiments, respectively, of the invention.
Figure 3:
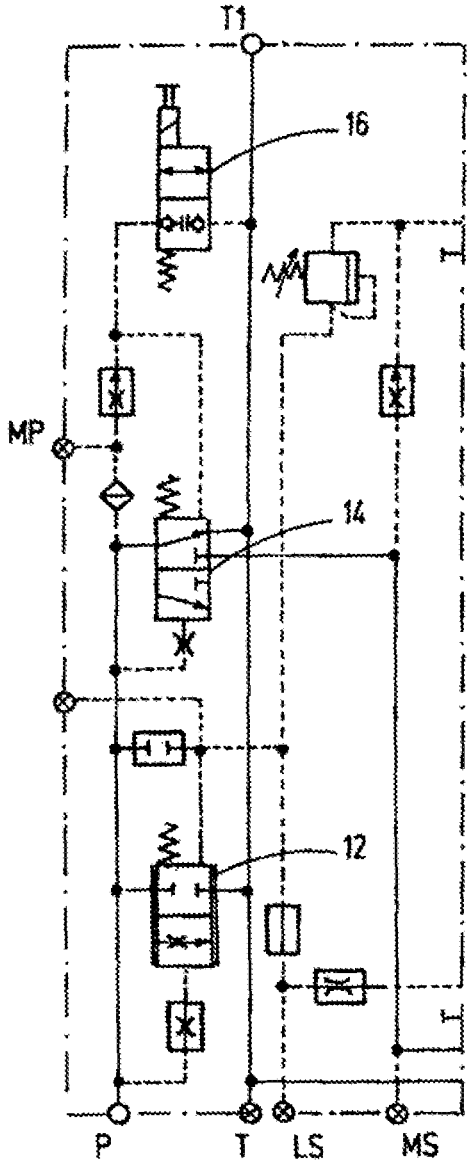

FIG. 1 relates to a section of an overall hydraulic circuit diagram depicting representations of individual hydraulic components, as they are customary for such circuit diagrams. Below, however, the hydraulic switch valves according to FIGS. 1 to 3 are explained only insofar as they are necessary to explain the control device according to the invention. The letters used in the figures, insofar as they are necessary for explaining the invention, have the meanings specified below:

| | |
|---|---|
| P | pressure supply source port |
| T | return port or tank port |
| LS | load-sensing line |
| LX | load-sensing control line |
| A, B | utility or supply ports for a hydraulic consumer (not shown) of a working section |
| A 1 | consumer (not shown) of a working section, utility or supply port for a further hydraulic consumer (not shown) of a further working section |
| T 1 | port for a neutral circulation in the direction of the tank or return T |
| MS | measuring port for a pressure transducer PI |
| Z, C | control lines for pilot pressure generation for pilot valves of a control valve |
| MP, MY, PC | further hydraulic connection ports. |

The associated connection port P of a customary pressure supply source can in turn be supplied with fluid of a normally pre-settable pressure by a fixed-displacement pump or variable-displacement pump (not shown). Starting from the connection port P at the pressure supply source, one pump line 10 has ends on the input side of a circulation pressure compensator 12, of a diverter or switch valve 14 and of a pilot solenoid valve 16, respectively. Output sides of the pressure compensator 12 and solenoid valve 16 lead into a return line or tank line, leading to the return port or tank port T. In the embodiment according to FIG. 3, that is, in the embodiment T1, the output side of the valve 14 also opens into the return line or tank line. The lines shown as dashed lines in the figures illustrate that those lines are used to actuate correspondingly connected hydraulic components.

The two opposing control sides of the circulation pressure compensator 12 are connected to control lines, which are supplied via the pump line 10. As seen in the viewing direction of FIG. 1, the upper control line is connected to the pump line 10 via an aperture or throttle 20. For the rest, the circulation pressure compensator 12 is held by a spring in the unactuated state in its closing or locking position shown in FIG. 1. Any rectangular boxes shown in the circuit diagram, which are penetrated by a fluid line or fluid passage point, are placeholders, which can be equipped with other hydraulic components if necessary.

Viewed in the direction of FIG. 1 and accordingly hydraulically downstream, there is the diverter valve 14, which is designed as a 3/2-way switch valve and which constitutes an "OR gate" in terms of switching logic. In the basic position shown in FIG. 1, the diverter valve 14 establishes a fluid-bearing connection between the pump line 10 and the port A1. The two opposing control lines for the diverter valve 14 are in turn connected to the pump line 10, wherein a shutter or throttle 22 is installed in the lower control line as viewed in the direction of FIG. 1. If the diverter valve 14 is actuated by fluid, a fluid-bearing connection between the pressurized pump line 10 is established in the direction of the connection ports A or B against the action of the spring force, which will be explained in further detail below.

The pilot solenoid valve 16 is also provided in superposition and hydraulically downstream, which is shown spring-loaded in its indicated blocking or normally-closed position. If the valve 16 is actuated by the solenoid, it reaches its open position and provides a fluid connection between the valve pump line 10 and the return line or tank line 18. A protective filter 24 and a first flow regulator 26 are installed between the two input sides of the valves 14 and 16. A connection port MP opens between the protective filter 24 and the flow regulator 26, viewed from the pump line 10, from a first control block 30 of the control device, which first control block is depicted by a dot-dash line. Within the control block 30, there is yet another block or second control block 32, depicted by a dot-dash line. The second control block 32 comprises the essential components of the emergency-stop device, having in particular of the diverter valve 14, the pilot control solenoid valve 16 and the protection filter 24 and the flow regulator 26.

A conventional, and therefore, not described pilot-pressure-supplied control valve 34 is used to actuate the two ports A, B. This control valve is shown in FIG. 1 in its locked valve slider position having a connection port at the input-side, which is connected to the load sensing line LS via a double-check valve 36. If the valve slider of the control valve 34 reaches its lower switching position as viewed in the direction of FIG. 1, for a correspondingly operated diverter valve 14, the supply pressure or pump pressure in the pump line 10 is passed to the utility port A via the supply line 38 connected to the diverter valve 14 at the output side and the control valve 34 on the output side of the control valve 34, whereas the utility port B is connected to the return port or tank port T via the control valve 34 in this switch position. If the control slide 34 reaches its upper position shown in FIG. 1, the utility port B is supplied with the pump pressure and the utility port A is switched to the return or tank T. Two pilot valves 40 are used to control the spring-loaded control valve slide of the valve 34, each having its own actuation via the control lines Z, C, of which for reasons of simplicity the fluid guide is shown only for one pilot valve 40, where the control line Z leads to the one pilot valve and the other control line C leads to the other pilot valve 40.

A connecting line 42 also opens in the control oil tank line of the control line Z for each pilot valve 40, in which preferably a further or second flow regulator 44 is installed in the form of a valve. The connecting line 42 is connected to the supply line 38 at a junction 46. Furthermore, the control line Z is permanently connected, bearing fluid, to the pressure-supplying pump line 10 via a first pressure-limiting valve 48 and via the aperture or throttle 20. A filter device 50 in conjunction with a further or second pressure-regulating valve 52 generates the internal pilot pressure for the pilot valves 40 in the context of the electro-hydraulic valve actuation for the individual working sections. To this end, the further pressure regulating valve 52 is connected on the output side to the further control line C. The control lines Z, C are shown to lead into corresponding connection ports Z, C at the output of the control block 30. Likewise, the load-sensing line LS is shown on the output side ending in the connection port LS at the block 30.

On the input side of the control valve 34, the supply line 38 is shown leading into a flow regulating valve 54, which is actuated by a load-sensing pressure of the control valve 34, as shown. Furthermore, as seen in the direction of FIG. 1, the supply line 38 opens at its lower end into a measuring port MS, to which a PI pressure transducer 56 can be connected.

In the embodiment shown in FIG. 1, a hydraulic working cylinder, not shown, and its two fluid or work chambers are to be connected to the connection ports A, B, thereby forming a first hydraulic working section. The working cylinder shall control the crane arm or lifting arm of a mobile crane. Yet another hydraulic working section is connected to the connection port A1, which in turn supplies hydraulic support cylinders, which, when extended, stabilize the platform of the mobile crane such that it cannot overturn or buckle on one side during operation. This use of the control device is only an example. Other obvious application options are conceivable.

If the pilot valve 16 is actuated, i.e. brought into its fluid-passing position, the diverter valve 14 moves into its lower switching position and then supplies the relevant assignable pilot valve 40 with pump pressure via the pump line 10, as described above, resulting in a corresponding deflection of the control slide of the control valve 34 and to the supply of the connection ports A or B of the first hydraulic working section with fluid pre-settable pressure for operating the first hydraulic working section. Now, if the pilot valve 16 is actuated and reaches its shown, normally closed position, the diverter valve 14 is moved by spring actuation into its position shown in FIG. 1 and then the fluid is solely supplied under pressure via the pump line 10 in the direction of the connection port A1 having the further or second hydraulic working section.

In the application example shown for the mobile crane, the support cylinders for the platform of the mobile crane are then supplied accordingly, which increases the safety, as they can then perform their support function. On the other hand, the supply line 38 is then shut off from the pressure supply, resulting in the relevant pilot valve 40 no longer being actuated. Therefore, the valve spool of the control valve 34 then reaches its locking basic position as shown in FIG. 1, assisted by the spring, and in that way certainly cuts off the fluid supply of the first hydraulic working section from the supply via the respective utility ports A or B.

For a correspondingly actuated emergency-stop function via the associated shutdown device 32, the supply is then definitely cut off even in case of pulling or pushing loads in the first working section such that the hydraulic consumer connected in the first working section can no longer move. Thus, only one solenoid valve 16 is needed to simultaneously interrupt the hydraulic energy flow from the pressure supply to the individual first working section and the pilot pressure supply of the electro-hydraulic control slide actuation to the control valve 34, which has no equivalent in the prior art.

Instead of the solenoid valve 16 according to the illustration of FIG. 1, which is normally closed, optionally, if necessary, another pilot solenoid valve can be used, which is normally open in the normal position and moves to its closed locking position upon actuation. Depending on the type of pilot valve 16 then used, it can then be decided in which position the emergency-off valve 14 shall be energized or de-energized and which circuit having the hydraulic working sections (A, B, A1) shall be activated. Due to the arrangement where the protection filter 24 and the flow regulator 26 arranged hydraulically downstream act as an aperture device, the individual pilot solenoid valve 16 can safely protect dirt from entering, which significantly contributes to reduce the potential risk of failure of the required safety function.

On the output side of the emergency stop shut-off valve in the form of the shuttle valve 36, the measuring port MS provides the option of monitoring the existing pressure between the valve 14 and the actuated working sections and thus the switching position of the emergency stop valve 14. The further flow regulator 44 then contributes to any small amounts of leakage being discharged via the emergency-off valve 14 in the direction of the control oil tank line via the control line Z, and thus, prevents the pressure signal at the measuring port MS from becoming distorted.

FIG. 2 shows the conditions of the control block 30 in the viewing direction to the left of the control valve 34 for a better illustration. The statements made so far also apply to the hydraulic components according to FIG. 2.

FIG. 3 in turn corresponds to the view according to FIG. 2, with the proviso that the PI-pressure sensor 56 is not shown at the measuring port MS. Also, instead of the port A1 for a further hydraulic working section, the corresponding connection port T1 is modified. Connection port T1 provides the option, especially for the use of fixed-displacement pump systems, of optionally choosing between the internal working circuit of the corresponding working section and either the neutral circulation in the direction of the return port or the tank port T via the port T1 as shown in FIG. 3. In this case, the usual neutral circulation is generally provided by the circulation pressure compensator 12 in the fixed-displacement pump systems described above. Pressure compensator 12, as shown, is always unilaterally spring loaded. Depending on the spring pre-load, usually between 9 and 16 bar, this pressure compensator 12, in conjunction with the pump volume flow, results in a power loss. As the diverter valve 14 in the form of the OR gate does not have to fulfill any regulating tasks, but needs to be designed only as a simple switch valve, the spring force for the circulation pressure compensator 12 can accordingly be rated smaller. In this way, the power loss can be reduced by a factor of 3 to 4 compared to conventional systems, as described, and be combined with the safety shutdown.

While various embodiments have been chosen to illustrate the invention, it will be understood by those skilled in the art that various changes and modifications can be made therein without departing from the scope of the invention as defined in the claims.

The invention claimed is:

1. A control device for first and second hydraulic work sections, the control device comprising:

a control block having first and second service ports connectable to the first and second work stations, respectively, having a pressure supply source port and having a return port; and a hydraulic supply circuit in the control block with a pilot pressure-supplied control valve and an emergency shutdown device, the first service port being connectable in fluid communication via the supply circuit and the pilot pressure-supplied control valve to the pressure supply source port and the return port, the emergency shutdown device including a pilot solenoid valve and a switch valve, hydraulic energy flow from the pressure supply source port to the respective service ports and the pilot pressure-supplied control valve via the switch valve being blockable by the pilot solenoid valve, the switch valve being actuatable as an OR gate depending on an actuation status of the pilot solenoid valve permitting selectively supplying fluid in a non-actuated shutdown function to one of the service ports and permitting selectively supplying fluid in an actuated shutdown function to another one of the service ports.

2. A control device according to claim 1 wherein the switch valve is a 3 port/2-way valve.

3. A control device according to claim 1 wherein the second service port is capable of supplying hydraulic load or permitting a neutral circulation in a direction of the return port.

4. A control device according to claim 1 wherein the control block comprises a pump line extending from the pressure supply source port and a circulation pressure compensator connected in fluid communication in the pump line to an input side of the switch valve and upstream of the switch valve.

5. A control device according to claim 1 wherein the pilot solenoid valve is connected in fluid communication downstream of an input side of the switch valve, the pilot solenoid valve being a 2-port/2-way valve and being optionally blockable in an initial position thereof or switchable to allow fluid to pass therethrough.

6. A control device according to claim 1 wherein a first current regulator is connected in fluid communication between an input side of the switch valve and an input side of the pilot solenoid valve.

7. A control device according to claim 6 wherein a protective filter is connected in fluid communication between the input side of the switch valve and an input side of the first current regulator.

8. A control device according to claim 1 wherein a measurement port is connected in fluid communication on an output side of the switch valve in a direction of one of the service ports upstream of an input side of the pilot pressure-supplied control valve.

9. A control device according to claim 1 wherein a second current regulator is connected in fluid communication on an output side of the switch valve in a direction of a pressure supply to pilot valves of the pilot pressure-supplied control valve.

* * * * *